United States Patent [19]

Mayer et al.

[11] Patent Number: 4,517,950

[45] Date of Patent: May 21, 1985

[54] METHOD AND DEVICE FOR CONTROLLING THE RECIRCULATION OF EXHAUST GAS IN A PRESSURE WAVE SUPERCHARGER FOR AN INTERNAL COMBUSTION ENGINE

[75] Inventors: Andreas Mayer, Niederrohrdorf; Ibrahim El-Nashar, Kloten; Fritz Spinnler, Liestal, all of Switzerland

[73] Assignee: BBC Brown, Boveri & Company, Limited, Baden, Switzerland

[21] Appl. No.: 491,215

[22] Filed: May 3, 1983

[30] Foreign Application Priority Data

Jun. 2, 1982 [CH] Switzerland ..... 3371/82

[51] Int. Cl.[3] ..... F02B 33/42

[52] U.S. Cl. ..... 123/559

[58] Field of Search ..... 60/39.45, 605; 123/559; 417/64

[56] References Cited

U.S. PATENT DOCUMENTS 2,853,987 9/1958 Berchtold et al. ..... 123/559

3,874,166 4/1975 Kirchhofer et al. ..... 123/559 X

FOREIGN PATENT DOCUMENTS 72059 2/1983 European Pat. Off. ..... 123/559

*Primary Examiner*—Michael Koczo

*Attorney, Agent, or Firm*—Burns, Doane, Swecker & Mathis

[57] ABSTRACT

Provision is made in the induced air duct and/or in the exhaust duct of the pressure wave supercharger for butterfly valves, by the control of which the exhaust gas proportion to be returned to the charge air is matched to the load condition of the engine. The adjustment of the butterfly valve or butterfly valves occurs through a linkage as a function of the load condition of the engine. A correction link acts on the linkage being provided to compensate for pressure alterations in the induced air duct and/or exhaust duct.

12 Claims, 9 Drawing Figures

METHOD AND DEVICE FOR CONTROLLING THE RECIRCULATION OF EXHAUST GAS IN A PRESSURE WAVE SUPERCHARGER FOR AN INTERNAL COMBUSTION ENGINE

BACKGROUND AND SUMMARY OF THE PRESENT INVENTION

The present invention concerns a method and device for controlling the recirculation of exhaust gas in a pressure wave supercharger for an internal combustion engine.

It is usual in internal combustion engines, in order to reduce the emission of pollutants, particularly the proportion of oxides of nitrogen and hydrocarbons, to mix exhaust gas with the combustion air in internal combustion engines, into the induction air in the case of naturally induced engines and into the compressed boost air in the case of supercharged engines.

With this return or recirculation of a part of the exhaust gases into the combustion air, the problem of the most effective metering of the returning exhaust gas proportion as a function of the engine load arises with all types of superchargers.

A primary recirculation of exhaust gas into the compressed boost air, i.e. one functioning without additional devices, by mixing air and exhaust gas at the separating line of the two media in the pressure wave supercharger can be obtained in a certain speed and load range of the engine, for example in the most heavily used range of a driving cycle, by an arrangement of the control edges, in which the expanded exhaust gas is not completely scavenged in the low pressure part. The proportion of the exhaust gas which is not scavenged is compressed in the high pressure part along with the fresh air and goes with the latter into the engine. The effectiveness of the high pressure side and the idle running properties of the engine are both worsened by this primary recirculation control by means of the control edge geometry. Since this recirculation control occurs by means of the low pressure scavenging, it is also affected by the low pressure resistances, which can change in the course of time, due particularly to filter dirtying.

Various solutions have been proposed for improving the recirculation variation over the whole operating range of pressure wave superchargers, for example by the Swiss Pat. No. 552,135. This patent describes a method and a device in which, in addition to the primary exhaust gas return, a secondary exhaust gas return is provided for the purpose of controlling the recirculation over the whole load range. According to FIGS. 7 and 8 of this Swiss patent, exhaust gas is branched off from the exhaust gas high pressure duct 5 and, at one position at least at which the cells of the rotor are filled with air, is introduced directly into the pressure wave process. The elements required for this purpose, however, complicate the supercharger and produce difficulties on installation in the vehicle. From the thermodynamic point of view, this solution has the disadvantage that the difference between the boost air pressure and the high pressure exhaust gas and also the boost pressure are reduced because of the extraction of high pressure exhaust gas. It is, however possible in this manner to obtain a better, matching of the degree of recirculation to the operating condition of the engine at any time than is possible by a primary exhaust gas return alone.

An objective of the present invention is to reduce the disadvantages of the known solutions outlined above with the smallest possible expenditure of constructional effort. In particular, the following requirements should be fulfilled:

The increase of the recirculation may only slightly worsen the efficiency of the pressure wave process on the high pressure side, it should be possible to optimize the high pressure side pressure difference and the level of the boost pressure independently of the recirculation criteria, it should be possible to optimize the degree of recirculation independently of the requirements of idling operation, and the degree of recirculation shall remain constant independently of the induction resistance, due for example to dirtying of the filter.

These objectives of the invention are attained by controlling the low pressure side scavenging alone, but the control edge geometry most favourable for the best pssible supercharging can be retained.

BRIEF DESCRIPTION OF THE DRAWINGS

The invention is described below with reference to the drawings, wherein like members bear like reference numerals, and wherein.

DETAILED DESCRIPTION OF THE PREFERRED EMBODIMENT

Figure 1:
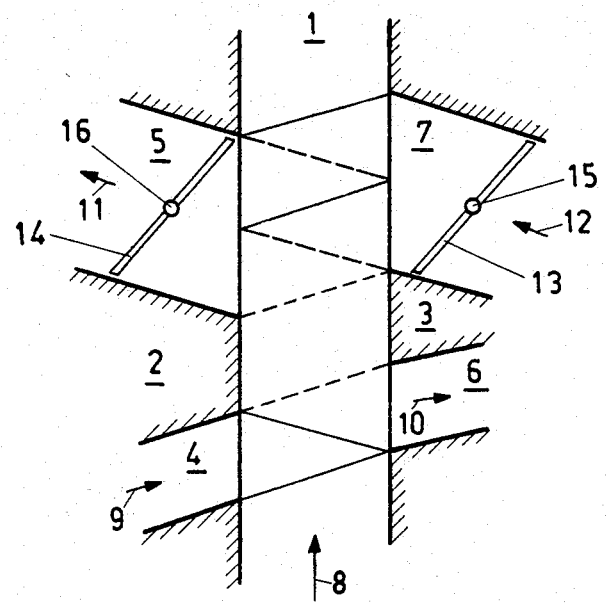
FIG. 1 is a schematic view of the elements responsible in principle for the control of the degree of recirculation control.

The schematic representation of FIG. 1 shows a part of the developed mid-section through the rotor space and the neighboring ducts in the air and gas casings of a pressure wave supercharger for a diesel engine. The supercharger includes the space 1 and one each of the two high pressure and low pressure exhaust gas ducts, namely 4 and 5, and high pressure and low pressure air ducts 6 and 7 of the gas casing 2 and the air casing 3, respectively. The arrow 8 indicates the rotational direction of the rotor and the arrows 9, 10, 11 and 12 the flow directions of the high pressure exhaust gas emerging from the engine, of the compressed high pressure boost air expelled from the rotor, i.e. the charged air, the low pressure exhaust gas blowing out from the rotor and the low pressure air flowing into the rotor, i.e. the induced air, respectively.

The basic idea of the invention consists in controlling the variation of the degree of recirculation as a function of the loading condition in the desired manner over the complete operating range by altering the induction resistance in the low pressure air duct 7 (i.e., induced air duct) and/or the exhaust resistance in the low pressure exhaust gas duct 5 (i.e., exhaust duct).

This influence on the degree of recirculation is obtained by the placing of butterfly valves 13 and 14 either in the low pressure air duct 7 or in the low pressure exhaust gas duct 5 or in both ducts. In the schematic arrangement of FIG. 1, both an induction butterfly valve 13 in the low pressure air duct 7 and an exhaust butterfly valve 14 in the low pressure exhaust duct 5 are provided. The rotational axes 15, 16 of these butterfly valves lie in the center of the butterfly valves and of the cross-sections of the ducts. Other valve arrangements and types of throttles, such as rotary slide valves or similar are, of course, also possible but, when fully opened, they should worsen the induction resistance and also the exhaust resistance as little as possible relative to the resistance of the free ducts.

The effect of such butterfly valves, which are provided, as mentioned, in one or both ducts, is explained with reference to FIG. 2, in which two rotor cells 17 are drawn in the rotor space, these rotor cells not being shown in the representation in FIG. 1. For ease of viewing, on the other hand, the butterfly valves 13, 14 are omitted in FIG. 2.

Figure 2:
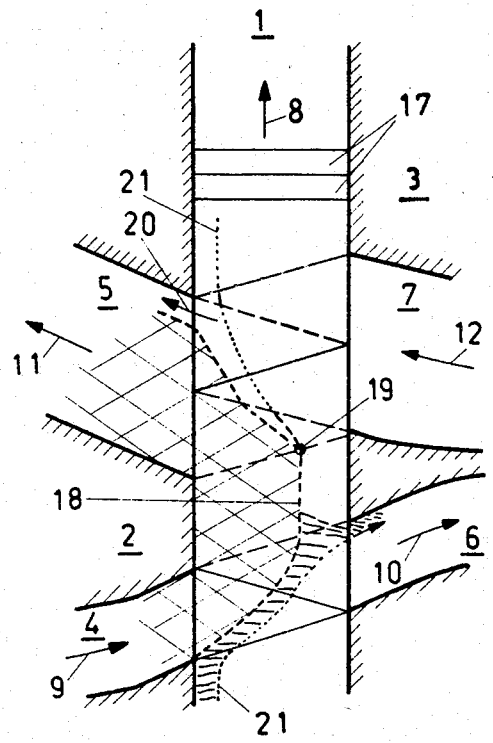
FIG. 2 is a view showing the shape of the dividing lines with and without recirculation control.

The line 18, composed of closely spaces dashes, in FIG. 2, represents the shape of the dividing line, as it forms from the high pressure region between the high pressure exhaust duct 4 and the high pressure air duct 6 if recirculation of exhaust gas does not occur there. The separating line 18 then remains in the high pressure region and always within the rotor space 1 as it continues as far as the entry into the region of the low pressure ducts 5 and 7. Thus under the idealised assumption that the mixing zone in the region of the dividing line remains narrow, no exhaust gas can enter into the duct 6, i.e. into the charged air. From the fork point 19 of the shape of the separating line 18, the latter bends into the low pressure exhaust gas duct 5, i.e. into the exhaust, which means that the induced air completely scavenges the exhaust gases and, to a small proportion indicated by the direction arrow 20, leaves the pressure wave supercharger together with the exhaust gases. Thus, under these conditions, there is theoretically no recirculation occurring. In practice, however, a pressure wave supercharger is so designed that a part of the mixing zone mentioned goes into the high pressure air duct 6 in a certain load range and this provides the primary exhaust gas recirculation mentioned at the beginning.

Using the two butterfly valves 13, 14, see FIG. 1, or one of them, the degree of recirculation can be increased and its variation controlled in the diagram of engine characteristics. By a throttling of the induced air flow in duct 7 by the butterfly valve 13 and/or the butterfly valve 14 in duct 5, the scavenging of the exhaust gases is hindered, so that the separating line 21, which now occurs in the low pressure region, takes the shape shown dotted from the fork point 19. It thus remains in the rotor space, i.e. in the rotor cells, after leaving the low pressure region. Thus exhaust gas goes into the high pressure region along with the induced air and it is there compressed together with the air and supplied to the internal combustion engine.

The separating line 21 between the induced air and the returning exhaust gas is maintained until entry into the next high pressure region, somewhat as in the upper part of FIG. 2, and is then displaced by the line of the high pressure exhaust gases towards and into the high pressure air duct. Since a pressure wave machine generally has two high pressure and two low pressure parts, the separating line 21 drawn in the lower part of FIG. 2 does not originate from the low pressure part 5 and 7 in the upper part of FIG. 2 but from the second low pressure part, which is not shown, whereas the upper separating line 21 passes into the second high pressure part, which is not shown.

Figure 3:
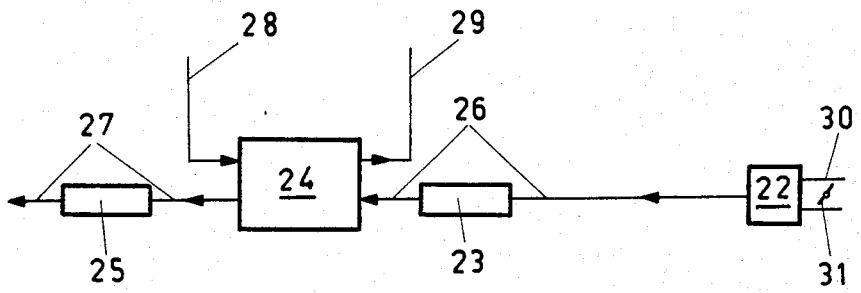
FIG. 3 is a block diagram of a pressure wave machine with controllable recirculation.

A block diagram of a pressure wave supercharger with controllable recirculation is shown in FIG. 3. In this diagram, 22 represents an induced air filter, 23 an induction noise muffler, 24 the pressure wave supercharger, 25 an exhaust noise muffler, 26 the induction pipe, 27 the exhaust pipe, 28 the high pressure exhaust gas pipe, 29 the boost air pipe, 30 an induction stub pipe installed in front of the air filter 22, in which induction stub pipe the induced air side butterfly valve 31 is provided. The latter could, as shown for example in FIG. 1, also be located directly in front of the emergence of the low pressure air duct into the rotor space but also at any given other position between the filter and the entry of the induced air into the rotor space which is favourable for the installation, the maintenance or the operating rods.

The location of a butterfly valve 31 in accordance with FIG. 3 in front of the filter 22 provides a sufficiently long settling length for the induced air, which is turbulent after passing through the butterfly valve.

In order to compensate for the increasing induction resistance with dirtying of the air filter 22, it is possible, as is shown later, to provide a compensation link, such as a pressure capsule, in the operating rods for the butterfly valve.

Figure 4:
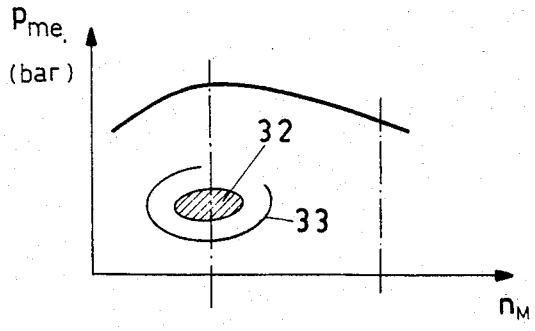
FIG. 4 is a graph of a recirculation characteristic curve.
Figure 9:
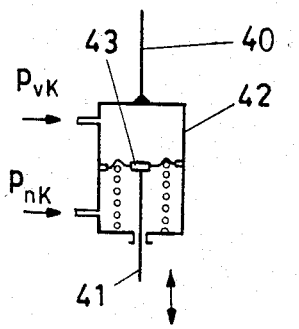
FIG. 9 shows a pressure capsule of the type connected between the rod elements of the control linkage.

The control for the butterfly valve will be preferably so designed that the valve is completely open at idle running and in the upper load range and also above a certain rotational speed. In these ranges, therefore, only primary recirculation is then effective. FIG. 4 shows an idealised recirculation characteristic diagram, in which the pivoting angle $\alpha$, see FIG. 6, of the butterfly valve can be constant or controlled in the shaded area, the so-called "recirculation island" 32, in order to maintain the desired variation of the degree of recirculation. The loop 33 is for constant recirculation.

Figure 5:
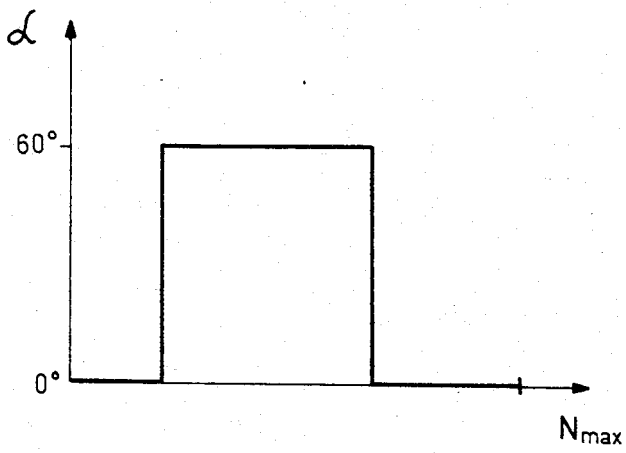
FIG. 5 is a graph of a control diagram for the degree of recirculation.
Figure 6:
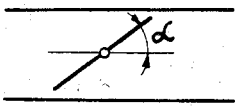
FIG. 6 is a view illustrating the definition for the butterfly angle.

Practically important possibilities of butterfly valve control are, for example:

the butterfly valve is brought mechanically into two positions by the gas pedal, fully opened in a certain lower load range including idling and in an upper load range up to full load and in a second, partially opened position, for example with a butterfly angle of 60°, as is shown in the opening diagram of FIG. 5, where the ordinate represents the butterfly valve angle defined in FIG. 6 and the abscissa represents the load or the gas pedal position which depends on it.

The opening and closing of the butterfly valve occurs by a rotational speed sensor which controls the butterfly valve so that the recirculation is reduced in the upper rotational speed range.

Control of the butterfly valve as a function of the degree of primary recirculation.

Figure 7:
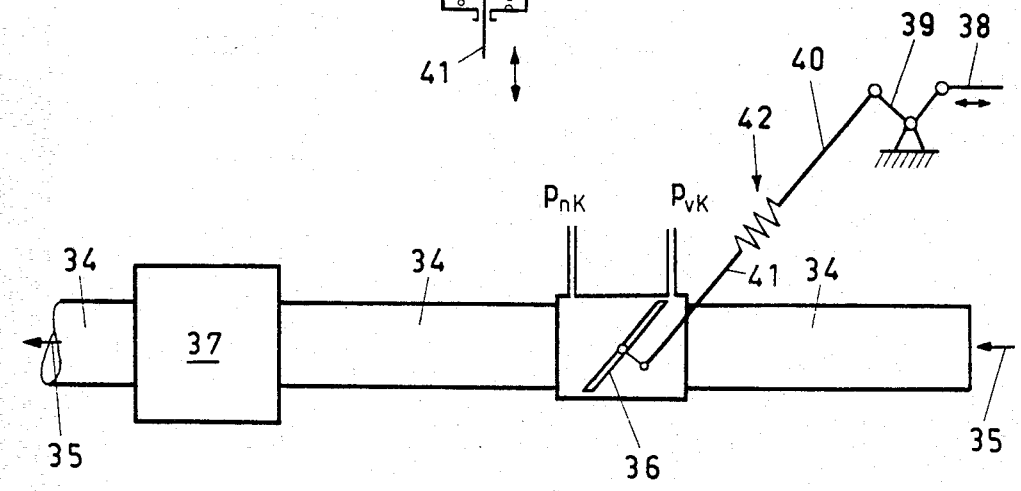
FIGS. 7 and 8 are schematic views of two possible devices for a control of the degree of recirculation.

FIG. 7 shows schematically a device for controlling the butterfly valve position in a diesel engine as a function of the gas pedal position to compensate for an alteration to the induction resistance dependent on the degree of dirtying of the air filter and on the rotational speed.

The induced air pipe 34 has flow in the direction indicated by the two flow arrows 35, i.e. the butterfly valve 36 comes before the air filter 37. The butterfly valve 36 is operated in the desired manner dependent on load or rotational speed by the throttle linkage 38, 39 via a sprung element installed between the rods 40, 41, the sprung element having the form of a pressure capsule 42 shown in the auxilliary figure. In the main figure, this pressure capsule 42 is shown schematically as a spring. The double arrow 44 indicates this relationship. The adjustment of the butterfly valve 36 which would occur with a rigid connection of the throttle linkage to the butterfly valve has superimposed on it, due to the pressure capsule 42, a correction movement which compensates for an alteration to the induction resistance because of dirtying of the filter and/or rotational speed alteration. The casing of the pressure capsule 42 is rigidly connected to the rod 40 and its spring loaded diaphragm 43, which is subjected to pressure on both sides, is rigidly connected to the rod 41.

The possible pressures to which the diaphragm 43 can be subjected are, for example, the static pressure $p_{vK}$ and $p_{nK}$ in the induced air pipe before and behind the butterfly valve 36. Another pressure difference, preferably in the induction region of the pressure wave supercharger, could, however, also be found usable for this purpose.

Figure 8:
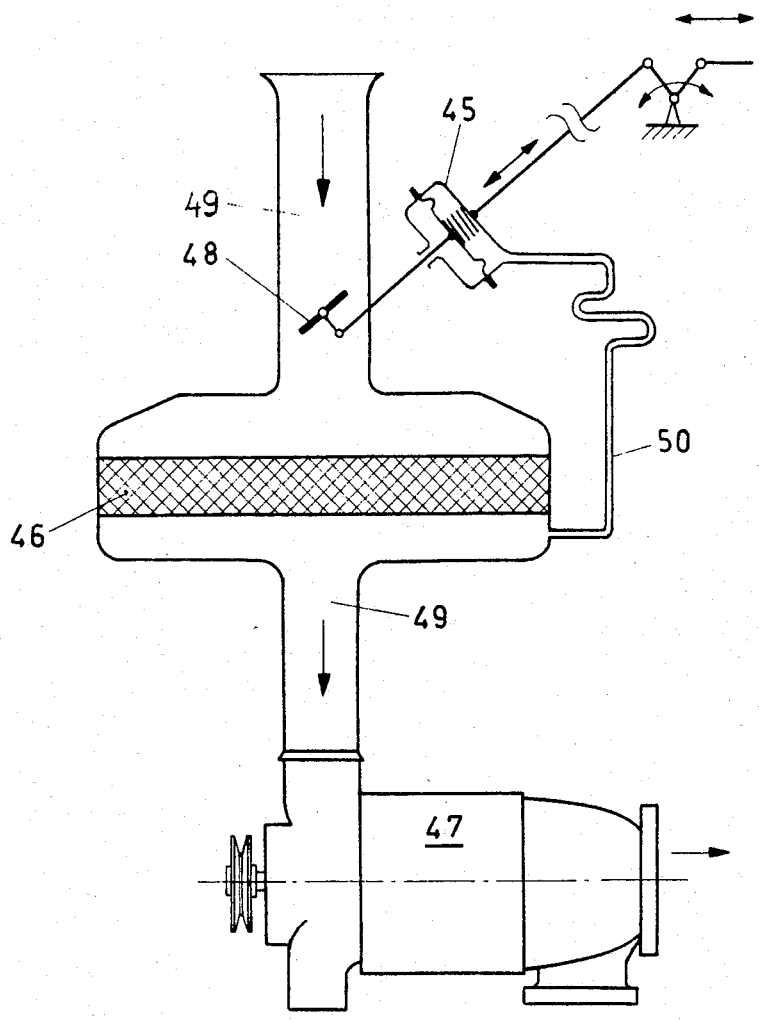

In accordance with FIG. 8, the compensation for an alteration of the induction resistance can also be attained by means of a pressure capsule 45 in which the pressure difference between the ambient air and the induced air pipe 49 after the air filter 46 is used for compensating for the alteration of the induction resistance, for which purpose a pressure tapping pipe 50 is provided between the spring loaded upper side of the pressure capsule 45 and the induced air pipe 49 behind the filter.

With respect to FIGS. 1 and 2, it should also be mentioned that the obliquely running full lines in the rotor space represent compression waves and the obliquely running interrupted lines the expansion waves of the pressure wave process.

In order to prevent failure of the flow through the rotor and thus of the rotor cooling due to an unprogrammed closing of a butterfly valve as a consequence of damage in the operating linkage, which occurrence could lead to the destruction of the supercharger, provision is to be made for measures which prevent such a danger, for example a stop which so limits the butterfly valve pivoting angle that the induced air pipe can never be completely closed. Such a stop will preferably be provided as near as possible to the axis of the butterfly valve. A further advantageous measure for this purpose consists in connecting the butterfly valve with the shifting valve, through which the engine can induce the combustion air directly from the atmosphere during the starting period, so that the shifting valve is open when the butterfly valve is closed. A further possibility consists in the use of a return spring which pivots the butterfly valve back into the fully opened position in the case of damage.

Simpler measures consist in providing the butterfly valve with holes or by making it only so large that it still keeps a part of the cross-section of the induced air pipe free at the largest possible pivoting angle.

The statements made with respect to the butterfly valve in a low pressure air duct or in an induced air pipe with respect to the control or regulation and the compensation in consequence of pressure alterations in the induced air flow also apply appropriately with respect to an exhaust butterfly valve in the low pressure exhaust gas duct or in the exhaust pipe, the exhaust butterfly valve being provided alone or in combination with an air butterfly valve.

The principles, preferred embodiments and mode of operation of the present invention have been described in the foregoing specification. However, the invention which is intended to be protected is not to be construed as limited to the particular embodiments disclosed. The embodiments are to be regarded as illustrative rather than restrictive. Variations and changes may be made by others without departing from the spirit of the present invention. Accordingly, it is expressly intended that all such variations and changes which fall within the spirit and scope of the present invention as defined in the claims be embraced thereby.

What is claimed is:

1. Method for controlling the recirculation of exhaust gas in a pressure wave supercharger connected between an induction pipe and an exhaust pipe for an internal combustion engine, said supercharger including high pressure and low pressure exhaust gas ducts and high pressure and low pressure air ducts and, a butterfly valve provided in at least one of the ducts, comprising the steps of controlling the variation of the degree of recirculation as a function of the load condition of the internal combustion engine by altering the flow resistance in at least one of the low pressure ducts of the pressure wave supercharger.

2. Method as claimed in claim 1, wherein the flow resistance in the low pressure air duct is altered.

3. Method as claimed in claim 1, wherein the flow resistance in the low pressure exhaust gas duct is altered.

4. Method as claimed in claim 1, wherein the flow resistance in the low pressure air duct and the flow resistance in the low pressure exhaust gas duct is altered.

5. Pressure wave supercharger for an internal combustion engine, comprising a device for controlling the recirculation of the exhaust gases, a rotor casing which accepts a rotor provided with cells through which gas flows axially, an air casing with an inlet flow duct for the induced air and an outlet flow duct for the compressed boost air, a gas casing with an inlet flow duct for the high pressure exhaust gases and an outlet flow duct for the exhaust gases, the inlet flow duct for the high pressure exhaust gases and the outlet flow duct for the boost pressure exhaust gases and the outlet flow duct for the boost air forming the high pressure side and the outlet flow duct for the exhaust gas and the inlet flow duct for the induced air forming the low pressure side of the pressure wave supercharger, a butterfly valve provided in at least one of the ducts of the low pressure side and, an operating device for the control or regulation of the degree of recirculation being operatively connected with said butterfly valve.

6. Pressure wave supercharger as claimed in claim 5, wherein a butterfly valve is provided in both the outlet flow duct for the exhaust gases and in the inlet flow duct for the induced air.

7. Pressure wave supercharger as claimed in claim 5, wherein a butterfly valve is provided only in the outlet flow duct for the exhaust gases.

8. Pressure wave supercharger as claimed in claim 5, including an air filter and wherein a butterfly valve is provided only in the induced air duct, the butterfly valve being located before the air filter in the direction of air flow.

9. Pressure wave supercharger as claimed in claim 5, including a control linkage and wherein the operating device for the butterfly valve or the butterfly valves comprises a linkage connected to the control linkage of the engine.

10. Pressure wave supercharger as claimed in claim 5, further comprising a compensation means for acting on the operating device to balance the effect of pressure alternations in the inlet flow duct.

11. Pressure wave supercharger as claimed in claim 10, including a control linkage and wherein the compensation means has a pressure capsule which is subjected to the pressures before and after the butterfly valve in the inlet flow duct and a linkage which kinematically couples the pressure capsule with the linkage of the operating device.

12. Pressure wave supercharger as claimed in claim 10, including an air filter and wherein the compensation means comprises a pressure capsule, a linkage of the operating device, a diaphragm in the pressure capsule being subjected to atmospheric air pressure and to the pressure behind the air filter in the induced air pipe.

* * * * *